US007161874B2

(12) United States Patent
Ichikawa et al.

(10) Patent No.: US 7,161,874 B2
(45) Date of Patent: Jan. 9, 2007

(54) POWER GENERATING TYPE ELECTRONIC TIMEPIECE

(75) Inventors: Masakazu Ichikawa, Souka (JP); Isao Kitazawa, Tokyo (JP)

(73) Assignee: Citizen Watch Co., Ltd., Tokyo (JP)

( * ) Notice: Subject to any disclaimer, the term of this patent is extended or adjusted under 35 U.S.C. 154(b) by 591 days.

(21) Appl. No.: 10/069,489

(22) PCT Filed: Jun. 21, 2001

(86) PCT No.: PCT/JP01/05322

§ 371 (c)(1),
(2), (4) Date: Jul. 2, 2002

(87) PCT Pub. No.: WO01/98843

PCT Pub. Date: Dec. 27, 2001

(65) Prior Publication Data

US 2002/0183865 A1 Dec. 5, 2002

(30) Foreign Application Priority Data

Jun. 21, 2000 (JP) ..... 2000-185667

(51) Int. Cl.
*G04C 3/00* (2006.01)

(52) U.S. Cl. ..... 368/204

(58) Field of Classification Search ..... 368/223, 368/203, 204, 205
See application file for complete search history.

(56) References Cited

U.S. PATENT DOCUMENTS

| | | | | |
|---|---|---|---|---|
| 4,328,572 | A * | 5/1982 | Kawahara | 368/204 |
| 4,428,040 | A * | 1/1984 | Yamashiro et al. | 363/62 |
| 6,278,663 | B1 * | 8/2001 | Okeya et al. | 368/204 |
| 2001/0028606 | A1 * | 10/2001 | Fujisawa | 368/204 |
| 2003/0174585 | A1 * | 9/2003 | Igarashi et al. | 368/66 |
| 2004/0100870 | A1 * | 5/2004 | Igarashi et al. | 368/66 |

FOREIGN PATENT DOCUMENTS

| | | |
|---|---|---|
| EP | 0 952 500 A1 | 10/1999 |
| JP | S51-58378 | 5/1976 |
| JP | S61-178497 | 11/1986 |
| JP | S62-85647 | 4/1987 |
| JP | S62-106165 | 7/1987 |
| JP | S2-156313 | 6/1990 |
| JP | H5-264751 | 10/1993 |

* cited by examiner

*Primary Examiner*—K. Cuneo
*Assistant Examiner*—Jeanne-Marguerite Goodwin
(74) *Attorney, Agent, or Firm*—Koda & Androlia

(57) ABSTRACT

The power generated by a power generating means (1) of a power-generating type electronic clock is measured by a first power generating sensing means (101) and a second power generating sensing means (102). The power generation level required when the operation is changed from a normal mode to a power-saving mode and the power generation level required when the operation is changed from the power-saving mode back to the normal mode are made different to prevent the phenomenon that the operation changes frequently by imparting hysteresis characteristics to the power generation level which causes a change in the mode, thereby improving the power-saving effect.

13 Claims, 6 Drawing Sheets

POWER GENERATING TYPE ELECTRONIC TIMEPIECE

TECHNICAL FIELD

The present invention relates to a structure or a control method of a power generating electronic timepiece in which power generating means or power generating means and an electricity storage section which is charged by the power generating means are mounted as a power supply and energy is saved by switching the operation state of the timepiece based on the amount of power generated by the power generating means.

BACKGROUND ART

Electronic timepieces in which various power generating means are mounted to supply energy for timepiece operation so that no exchange of batteries is necessary are already being commercialized. An electronic timepiece has been proposed in which, in order to further save energy, a portion of the circuit operations of the timepiece are frozen while the time information in the timepiece. FIG. 5 is a block diagram showing an example structure of a conventional power generating electronic timepiece.

Power generated by power generating means 1 such as a solar battery, a body temperature power generator, or an automatic winding power generator is charged to an electricity storage section 2 which is a secondary battery or a mass storage capacitor. The power is then supplied in a predetermined amount to the sections of a timepiece device 10 necessary to operate the timepiece, continuously in a small amount for counting time, or temporarily for driving a function which consumes a large amount of power, such as display illumination and an audio alarm. The timepiece device 10 includes the following circuits and devices.

A clock circuit 3 includes additional functions such as, for example, stopwatch and alarm. The clock circuit 3 outputs time information and various information for operating the additional functions as information resulting from a predetermined manipulation and calculation performed on a predetermined information, such as, for example, clock signal obtained from a reference frequency source, time signals of various periods produced based on the clock signal, and various values measured for the additional functions. A clock display section 5 includes a driving circuit for display, and displays the time information or information related to the additional functions produced by the clock circuit 3 through methods such as pointer (analog), digital display such as a liquid crystal, or alarm sound.

Power generation detecting means 100 includes a circuit for checking whether or not the power currently being generated by the power generating means 1 is greater than or equal to a predetermined level, and generates different outputs depending on whether or not the power is greater than or equal to the predetermined level (which is set at a level significantly lower than the normal level of power generation).

It may be thought that there is a direct correlation between the power level and usage state or environmental conditions of the timepiece such as, for example, the illumination of an optical power generating timepiece, difference between the temperature of the skin and the temperature of the atmosphere or the heat conduction state in a body temperature power generating timepiece, and strength of the movement in an automatic winding power generating timepiece.

Information processing means 4 receives output signals from the power generation detecting means 100 and, when the power generated by the power generating means 1 is at or exceeds a predetermined level, the information processing means 4 permits the time information and additional function information produced by the clock circuit 3 to drive the clock display section 5. Otherwise the information processing means 4 prevents transmission of this information. In the latter case, the clock circuit 3 continues to produce time information at a low power consumption, but the driving circuit in the clock display section 5 or the like which has a high power consumption is suspended, so that the timepiece device 10 enters a power save state. The arrow shown in the figure from the information processing means 4 to the power generation detecting means 100 indicates that the information processing means 4 in some cases generates a control signal for controlling the detection operation of the power generation detecting means 100. This corresponds to cases such as, for example, when the information processing means 4 suspends the detecting operation of the amount of power generated or when all the clock circuits are reset to the initial state.

Later, when the power generated by the power generating means 1 is restored to a level greater than or equal to the predetermined level, the display is also re-driven, although in a pointer type time display device, for example, there is a delay generated corresponding to the duration of the suspension. In light of this characteristic, the information processing means 4 includes a function to record the time when the display function is suspended due to decrease in the power generation and to drive the pointer in a fast forward motion to the correct current time at an early stage in time after the power is restored.

The predetermined power level is set at a level smaller than the power consumption of the timepiece device 10 and obtained by including a slight design margin in the level where it can be expected that continuation of the current level of power generation for a long period of time would cause the power charged in the electricity storage section 2 to decrease and the timepiece to eventually stop. The power level not only be indicated by the power itself, but can also be represented by other levels such as the voltage value level or the output current level generated by the power generating means. These values cannot only be measured instantaneously, but also by average value or accumulated value within a predetermined period until the current time.

The power generating means of the power generating electronic timepiece is designed so that sufficient power is generated under a normal usage condition. Therefore, by configuring the timepiece as above, for example, when a timepiece with an optical power generating device is stored and left in a drawer of a desk or the like (display of time and other functions would not be necessary for this time period), the timepiece enters the power save state as described above. When later the timepiece is taken out and is worn on the arm in a bright environment, the timepiece returns to the normal operation state and sufficient power to charge the battery is again generated. Therefore, because of the characteristics that no battery exchange is necessary and that the time need not be manually adjusted, a power generating timepiece is provided which has less restriction on the usage and without a restriction that the same timepiece must be always used.

Another conventional power generating electronic timepiece is equipped with a charge alarm display function. This function monitors the charge voltage of the electricity storage section and, when this voltage falls below a predetermined voltage detection value, the display is switched from normal display to a charge insufficiency alarm display (modulated display is performed). Japanese Patent Publication No. Hei 7-46145 discloses an art where hysteresis is provided for the voltage conditions for changing the display state which depend on the direction, wherein different voltage detection values of the electricity storage section are used in situations when switching from the normal display to the charge alarm display and when switching from the charge alarm display to the normal display.

In the prior art shown in FIG. 5, the power level for suspending a portion of the functions of the electronic timepiece due to decrease in the amount of power generated and the power level for restoring all functions due to increase in the amount of power generated are set at the same level. No significant problem arises if there is a sufficient difference between the power generation level in the normal operation state of the electronic timepiece and that in the power save state. However, the actual usage condition is not ideal, and there are cases where the power generation level fluctuates around the predetermined power level. When the timepiece is restored from the power save state to the normal operation state, a process, such as an operation for fast forwarding the pointer to the current time, is performed which consumes a large amount of energy.

Thus, when the power generation is at a low level and varies, frequent switching occurs and the power consumption in fact becomes large, resulting in negation of the intended power save effect. This may happen, for example, when the timepiece is moved between under the cloth and under no cloth or when the room illumination changes for a timepiece having a solar cell in the dial, when the contact with the skin changes for a body temperature power generating timepiece, and when the timepiece is used with small motion for a timepiece with automatic winding power generator.

The art disclosed in Japanese Patent Publication No. Hei 7-46145 described above is an art for warning of a charge insufficiency state, and not an art for saving power. An application of this prior art may enable switching of the timepiece between the normal state and the power save state by monitoring the charge voltage of the electricity storage section, but, even if the timepiece is switched to the power save state after the charge power in the electricity storage section is clearly decreased, it is highly probable that the remaining power is insufficient to drive the timepiece for a long period of time, and, thus, a power save function which is practical cannot be obtained.

One object of the present invention is to provide a power generating electronic timepiece and control method of such an electronic timepiece in which the switching process between a first state (for example, a normal state) and a second state (for example, a power save state) is improved in order to prevent frequent state change in a timepiece due to a small change in the amount of generated power, for example, when power is not generated or when power is generated at a low level, resulting in increased stability (for example, increased power save effectiveness) of the timepiece operation.

DISCLOSURE OF INVENTION

In order to achieve at least the object described above, according to the present invention, there is provided a power generating electronic timepiece having any of the following characteristics:

(1) a power generating electronic timepiece which operates using a power supply device as the energy source, the power supply device comprising at least power generating means, the power generating electronic timepiece comprising a time measuring circuit for measuring or calculating predetermined information and outputting the resulting information; display means for displaying time information or function information based on output signals from the time measuring circuit; and control means for controlling states of the power generating electronic timepiece such that when the amount of power generated by the power generating means is detected to be at a first power generation level, the state is changed from the first state before detection to a second state which is different from the first state, and when the amount of power generated by the power generating means is detected to be at a second power generation level, the state is changed from the second state to the first state, the second power generation level being different from the first power generation level;

(2) a power generating electronic timepiece which operates using a power supply device as the energy source, the power supply device comprising power generating means and electricity storage means to which generated power energy from the power generating means is charged, the power generating electronic timepiece comprising a time measuring circuit for measuring or calculating predetermined information and outputting the resulting information; display means for displaying time information or function information based on output signals from the time measuring circuit; and control means for controlling states of the power generating electronic timepiece such that when the amount of power generated by the power generating means is detected to be at a first power generation level, the state is changed from the first state before detection to a second state which is different from the first state, and when the amount of power generated by the power generating means is detected to be at a second power generation level, the state is changed from the second state to the first state, the second power generation level being different from the first power generation level;

(3) a power generating electronic timepiece which operates using a power supply device as the energy source, the power supply device comprising power generating means and electricity storage means to which generated power energy from the power generating means is charged, the power generating electronic timepiece comprising a time measuring circuit for measuring or calculating predetermined information and outputting the resulting information; display means for displaying time information or function information based on output signals from the time measuring circuit; and control means for controlling states of the timepiece such that when the amount of power generated by the power generating means is detected to be at a first power generation level, the state is changed from the first state before detection to a second state which is different from the first state, and when the amount of power generated by the power generating means is detected to be at a level equal to or higher than a second power generation level, the state is changed from the second state to the first state, the second power generation level being higher than the first power generation level;

(4) a power generating electronic timepiece, wherein when the amount of generated power of the power generating means is relatively small, it is determined that power is not being generated, and when the amount of generated power of the power generating means is relatively large, it is determined that power is generated;

(5) a power generating electronic timepiece which operates using a power supply device as the energy source, the power supply device comprising power generating means and electricity storage means to which generated power energy from the power generating means is charged, the power generating electronic timepiece comprising a time measuring circuit for measuring or calculating predetermined information and outputting the resulting information; display means for displaying time information or function information based on output signals from the time measuring circuit; and control means for controlling the state of the timepiece such that when it is detected that the amount of power generated by the power generating means is transitioned from a level greater than a first power generation level to a level equal to or less than the first power generation level, the state of the power generating electronic timepiece is switched from a first state to a second state which has smaller power consumption than the first state, and when it is detected that the amount of power generated is transitioned from a level less than the second power generation level higher than the first power generation level, to a level equal to or greater than the second power generation level, the state of the power generating electronic timepiece is switched from the second operation state to the first operation state;

(6) a power generating electronic timepiece, wherein as the first power generation level and the second power generation level, a predetermined detection value can be selected from among a plurality of detection values for respective power generation level;

(7) a power generating electronic timepiece, wherein an arbitrary optimal value is selected from among the plurality of detection values for the first power generation level and the second power generation level based on the charge capacity of the electricity storage means;

(8) a power generating electronic timepiece, wherein an arbitrary optimal value is selected from among the plurality of detection values respectively for the first power generation level and the second power generation level based on the temperature of the environment in which the power generating electronic timepiece is placed;

(9) a power generating electronic timepiece, wherein the control means determines that power non-generation is detected when the first power generation level is repeatedly detected within a predetermined time period;

(10) a power generating electronic timepiece, wherein the control means determines that power generation is detected when the second power generation level is repeatedly detected within a predetermined time period;

(11) a power generating electronic timepiece, wherein at least a portion of display operations of the display means is suspended in the second state;

(12) a power generating electronic timepiece, wherein a portion of operations of the time measuring circuit or of circuits other than the time measuring circuit are suspended in the second state;

(13) a power generating electronic timepiece, wherein at least a portion of the display means are constructed from an analog display mechanism or a digital display mechanism; and

(14) a power generating electronic timepiece wherein a member exhibiting a power generation effect by exposure to light energy is used for the power generating means.

In order to achieve at least the object mentioned above, according to the present invention, there is provided a method for controlling a power generating electronic timepiece, the method having any of the following characteristics:

(15) a method for controlling a power generating electronic timepiece which operates using at least power generating means as the energy source, the method comprising the steps of, when the amount of power generated by the power generating means is detected as at a first power generation level, switching the state of the power generating electronic timepiece from a first state before the detection to a second state different from the first state, and when the amount of power generated by the power generating means is detected as at a second power generation level different from the first power generation level, switching the state of the power generating electronic timepiece from the second state to the first state;

(16) a method for controlling a power generating electronic timepiece which operates using at least power generating means as the energy source, the method comprising the steps of, when the amount of power generated by the power generating means is detected to be at a level lower than or equal to a first power generation level, switching the state of the power generating electronic timepiece from a first state before the detection to a second state different from the first state, and when the amount of power generated by the power generating means is detected to be at a level higher than or equal to a second power generation level different from the first power generation level, switching the state of the power generating electronic timepiece from the second state to the first state; and

(17) a method for controlling a power generating electronic timepiece which operates using at least power generating means as the energy source, the method comprising the steps of, when it is detected that the amount of power generated by the power generating means is transitioned from a level greater than a first power generation level to a level lower or equal to the first power generation level, switching the state of the power generating electronic timepiece to a second state which has less power consumption than at a first state, and when it is detected that the amount of power generated by the power generating means is transitioned from a level lower than a second power generation level to a level greater than or equal to the second power generation level, the second power generation level being greater than the first power generation level, switching the state of the power generating electronic timepiece from the second operation state to the first operation state.

BEST MODE FOR CARRYING OUT THE INVENTION

Figure 1:
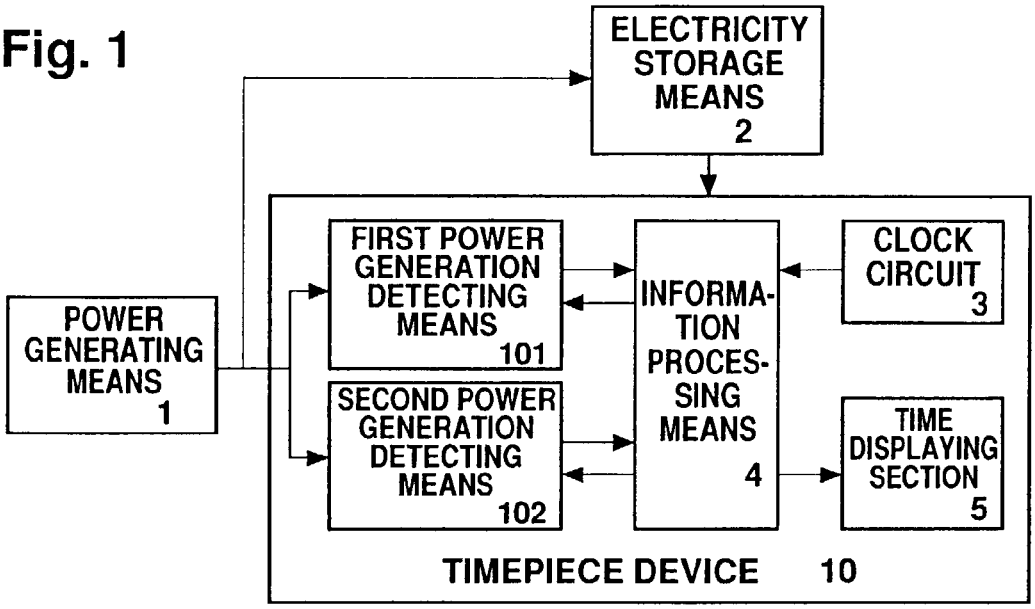
FIG. 1 is a block diagram showing a structure of a first embodiment of a power generating electronic timepiece according to the present invention.
Figure 5:
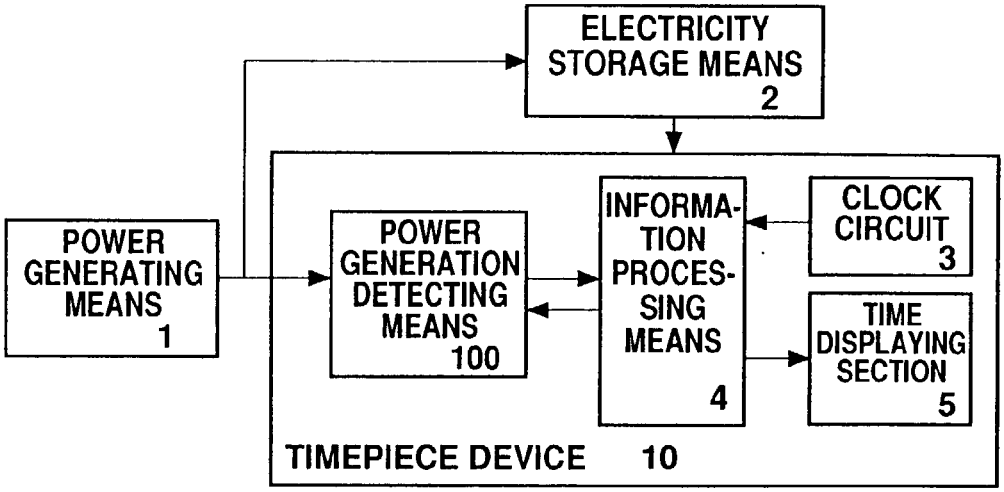
FIG. 5 is a block diagram showing an example structure of a power generating electronic timepiece of the prior art.

FIG. 1 is a block diagram showing a structure of a first embodiment of a power generating electronic timepiece according to the present invention. In the figures, the elements identical to those in the prior art are assigned the same reference numerals as FIG. 5 and will not be described again, unless some different function is added. The difference between the first embodiment and the prior art is that, in place of the power generation detecting means 100, there are provided first power generation detecting means 101 which produces an output when the detected value becomes lower than or equal to a predetermined first power level, and second power generation detecting means 102 which produces an output when the detected value becomes higher than a predetermined second power level which is slightly higher than the first power level.

The predetermined first power level is used for determination of switching from the normal state to the power save state (it is determined that the power generating means 1 is in power non-generating state) of the timepiece and the predetermined second power level is used for determination of restoring from the power save state to the normal state (it is determined that the power generating means 1 is in power generating state).

Figure 6:
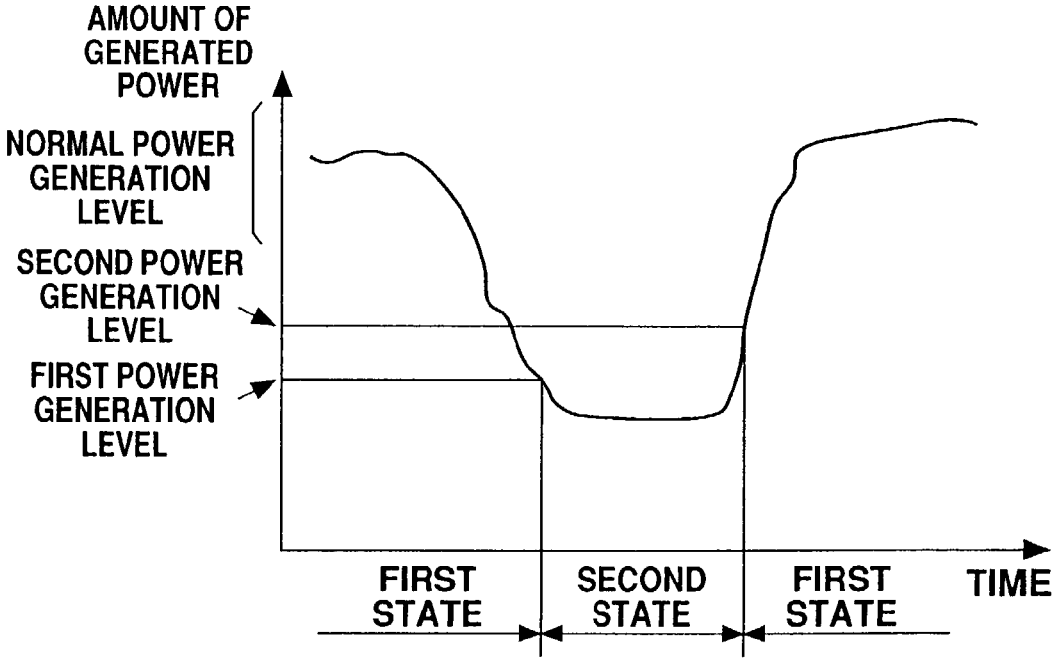
FIG. 6 is a diagram showing, in time, an example of progress in changes of the power generation level and changes in the state of a timepiece.

FIG. 6 is a diagram showing an example of the progress of changes in the power generation level and changes in the state of the timepiece with respect to time. Transition from a first state (in this case, normal state) to a second state (in this case, power save state) occurs at the first power generation level, and the recovery in the opposite direction occurs at the second power generation level, which is higher than the first power generation level.

Figure 7:
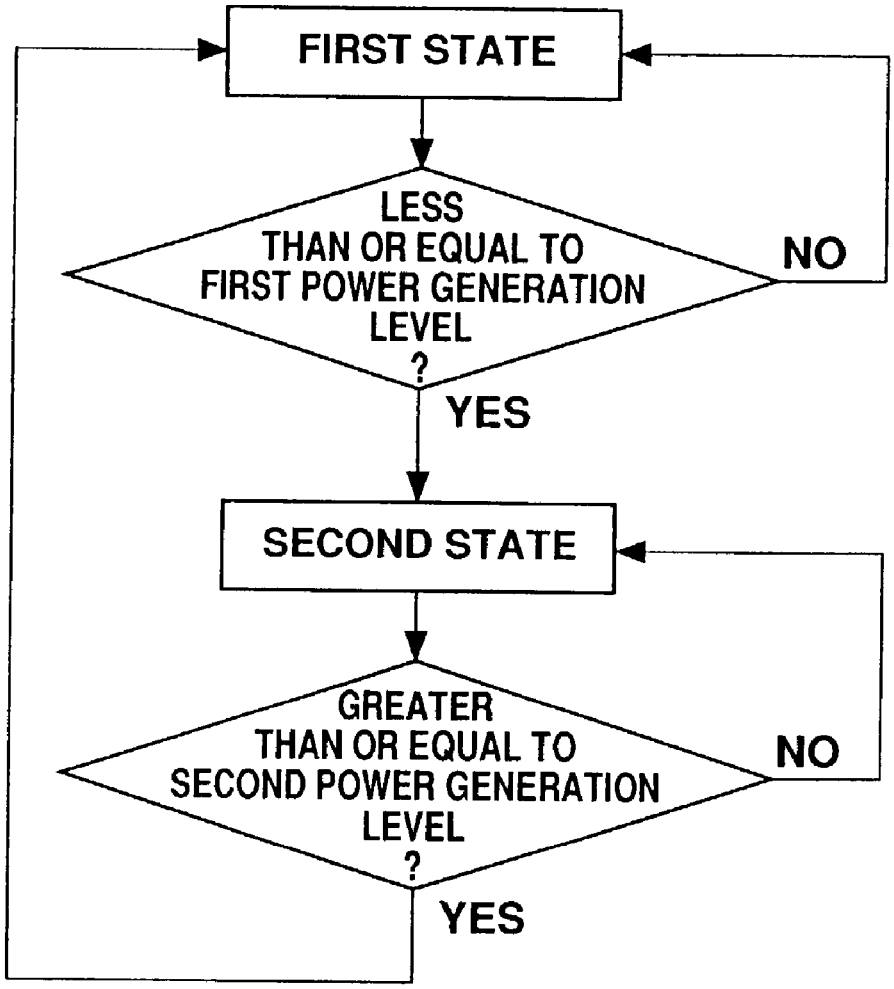
FIG. 7 is a flowchart showing the sampling process for controlling switching of the state of the timepiece while checking the power generation level.

The information processing means 4 according to the present invention checks the power generation level in cooperation with the first and second power generation detecting means 101 and 102 in order to set the state of the timepiece. FIG. 7 shows a flowchart of the sampling process. When the timepiece is at the first state, in the first stage, it is repeatedly checked whether or not the amount of generated power is less than or equal to the first power generation level. If the determination is NO, the timepiece is maintained at the current state, but if the determination is YES, the timepiece is transitioned to the second state. The timepiece is then maintained at this state, and it is repeatedly checked whether or not the amount of generated power is greater than or equal to the second power generation level. If the determination is NO, the current state is maintained and if the determination is YES, the timepiece is restored to the first state. The sampling operation is performed intermittently in order to reduce power consumption.

In such a structure, the power levels for the state transition from the normal to the power save and for the state transition from the power save to the normal are different, and thus a hysteresis is provided for the conditions for state change. For example, in an optical power generating timepiece, the timepiece becomes at a power save state when the illumination of the solar cell surface is significantly lowered, and the display operation is suspended, for example, but the recovery to the normal state occurs only when the illumination becomes slightly higher. Because of this, the timepiece does not easily return to the normal state even when the illumination varies around the level corresponding to the illumination level which generates the first power level.

When the illumination varies at around the level corresponding to the illumination level which generates the second power level, on the other hand, the timepiece does not easily change from the state to which it has recently returned to the power save state. Theoretically, with this structure, if changes in the level for the power generation condition are repeated between a level slightly lower than the first power level and a level slightly higher than the second power level, the state change occurs frequently. However, such a case of frequent large change in amplitude is significantly rarer than in the prior art in which only a single level is provided. Therefore, sufficiently improved power save effect can be achieved without the timepiece frequently transitioning between the normal and power save states.

Figure 2:
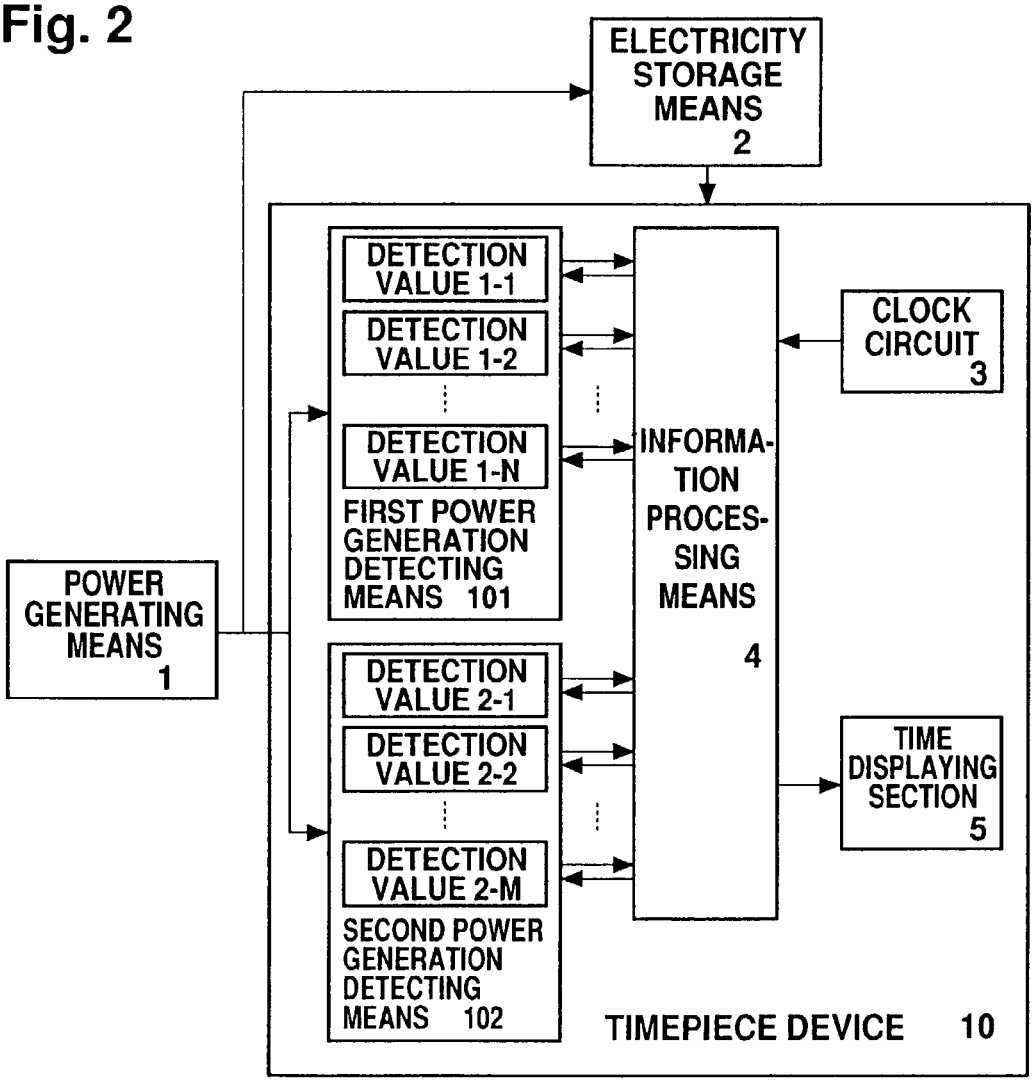
FIG. 2 is a block diagram showing a structure of a second embodiment of a power generating electronic timepiece according to the present invention.

FIG. 2 is a block diagram showing a structure of a second embodiment of a power generating electronic timepiece according to the present invention. The difference from the above first embodiment is that, instead of the first power generation detecting means 101 and the second power generation detecting means 102 detecting a single predetermined power level and generating an output, the first and second power generation detecting means 101 and 102 generate a plurality of detection values 1-1>1-2>. . . >1-N and 2-1>2-2>. . . >2-M, as shown in FIG. 2. The information processing means 4 selects a predetermined value from among the plurality of detection values according to conditions, and uses the selected detection value for the switching condition of the states. With such a structure, more sophisticated function for determination and control can be provided and finer control of power consumption can be achieved.

In this manner, by providing a plurality of power generation amount detection values (power generation levels), a plurality of power save states can be provided in the timepiece based on the detection value, and the timepiece can sequentially transition to deeper steps in the power save states or sequentially recover from the power save states (second embodiment). Alternatively, conditions other than the amount of generated power can be referred to for selecting different power generation detection value, and the detection values for switching states can be altered or adjusted based on the other conditions (third and fourth embodiments which will be described below). These will be described in more detail below. The information processing means 4 may operate only the necessary circuit from among a plurality of circuits for detecting the amount of generated power, and temporarily deactivate the others, in order to reduce the power consumption necessary for detection.

For example, if all of the plurality of detection values are less than the normal power and the number of detection values N=M=2, as the amount of generated power is lowered from the normal state, the operation state of the timepiece changes, so that, first, the second hand of the timepiece is suspended (hour and minute hands are not suspended) when the amount of generated power becomes lower than the detection value 1-1, and then the alarm function is suspended when the amount of generated power becomes lower than the detection value 1-2. When the amount of power generation is restored, the movement of the second hand is first restarted when the amount of generated power becomes greater than the detection value 2-2, and the alarm function is then restarted when the amount of generated power exceeds the detection value 2-1, to return to the normal state. The alarm function is restored at a later stage because the short-term power consumption of the alarm function is greater than that for moving the second hand. The security of the amount of remaining power in the electricity storage section 2 is considered and the functions are recovered beginning with functions having lower power. In other words, the plurality of functions such as the time display function and the additional functions are each assigned a priority number according to importance and power consumption, and the priority numbers are used to suspend and restart each function in a predetermined order.

The operation state of the timepiece can be any of the following examples and any combination of the following examples. (A) Only the second hand is suspended. If the hour and minute hands are driven by separate motors, because the time period between the movement of these hands is long and the power consumption is low, time display can be continued with the power saved to a certain degree. (B) The liquid crystal display is suspended. Power can be saved including that for operating the voltage boosting circuit and driving circuit. (C) A portion or all of the additional functions such as an alarm, chronograph, timer, EL illumination of the dial, and sensor function (for example, bathometer or altimeter) are stopped (in a predetermined order). (D) Oscillation of the time system and/or the operation of frequency divider circuit is suspended. The time information is lost. (E) The microcomputer circuit or the random logic circuit which operate the timepiece is suspended (power supply is blocked and the circuit is set to be in a hold state).

In this case, various conditions set at the normal operation before the amount of the generated power is reduced are stored in the circuit as a voltage value, and, even if the time information is lost, for example, recovery is easy as it is only required to set the time after the power generation is restored. The power consumption is very small (few nA), and this state can be maintained for more than ten years even when the power generation is completely stopped.

Another example of the second embodiment according to the present invention will now be described. A first state of the timepiece is set as the normal state, a second state of the timepiece is set as the state where the second hand is suspended and the liquid crystal display is not shown, a third state of the timepiece is set as the state where the additional functions are suspended and microcomputer is set on hold further to the second state, and the fourth state is set as the state where the operations of minutes and hands and the oscillation and frequency divider circuit are suspended further to the third state. It is preferable that the power levels for transitioning to a low power state and for restoring be different, but this is only significant for switching between levels of large power save effect (for example, normal state and the following first step of power save state), and the levels for transitioning between, for example, the third and fourth states which have only a small difference in power consumption may be set at a same level. With such a structure or control method, a power generating electronic timepiece or control method of such electronic timepiece can be provided in which the power save effect is significant and the probability that a particular manipulation is required after restoration is low.

When a plurality of power generation detecting levels are provided, the number of detection values N need not necessarily be identical to the number of detection values M. The same function and same combination of functions need not be suspended or restarted when transitioning into the power save state or when restoring. A portion of the power generation detecting level may be set to correspond to an amount of generated power higher than the normal state in order to enable operations such as forceful discharge to protect the electricity storage section 2 and the timepiece device 10 from excessive voltage or the like.

Figure 3:
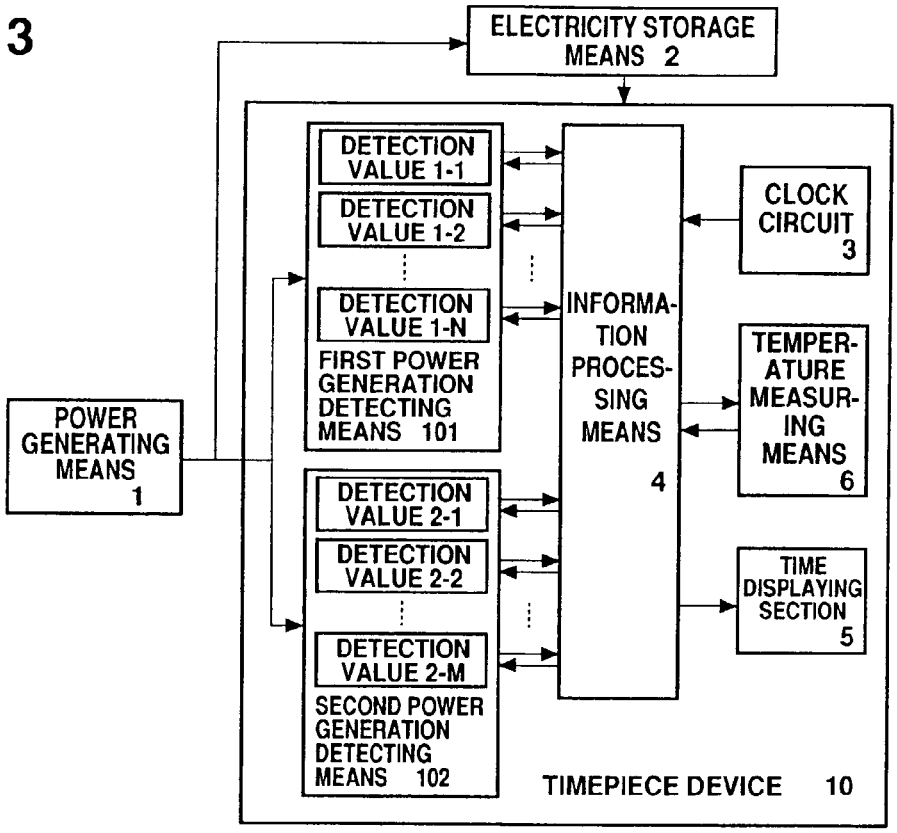
FIG. 3 is a block diagram showing a structure of a third embodiment of a power generating electronic timepiece according to the present invention.

FIG. 3 is a block diagram showing a structure of a third embodiment of a power generating electronic timepiece according to the present invention. The difference from the above second embodiment is that environmental temperature information of the timepiece detected by separately provided temperature measuring means 6 is included in the input to the information processing means 4 so that the temperature characteristic of the power supply device and the components of the timepiece are also considered as a condition for switching states, and an optimal state is selected and used based on the plurality of power detection values finely set by the first and second power generation detecting means 101 and 102. Because the internal resistance of the electricity storage rapidly increases at a low temperature, a higher power detection value is selected and used for switching states, as the temperature is lowered. With such a structure, switching can be performed with even finer levels of selection. Thus, such a structure enables provision of a power generating electronic timepiece with higher power saving effect and easier management ability (ability to avoid suspension) or a control method of such electronic timepiece.

Figure 4:
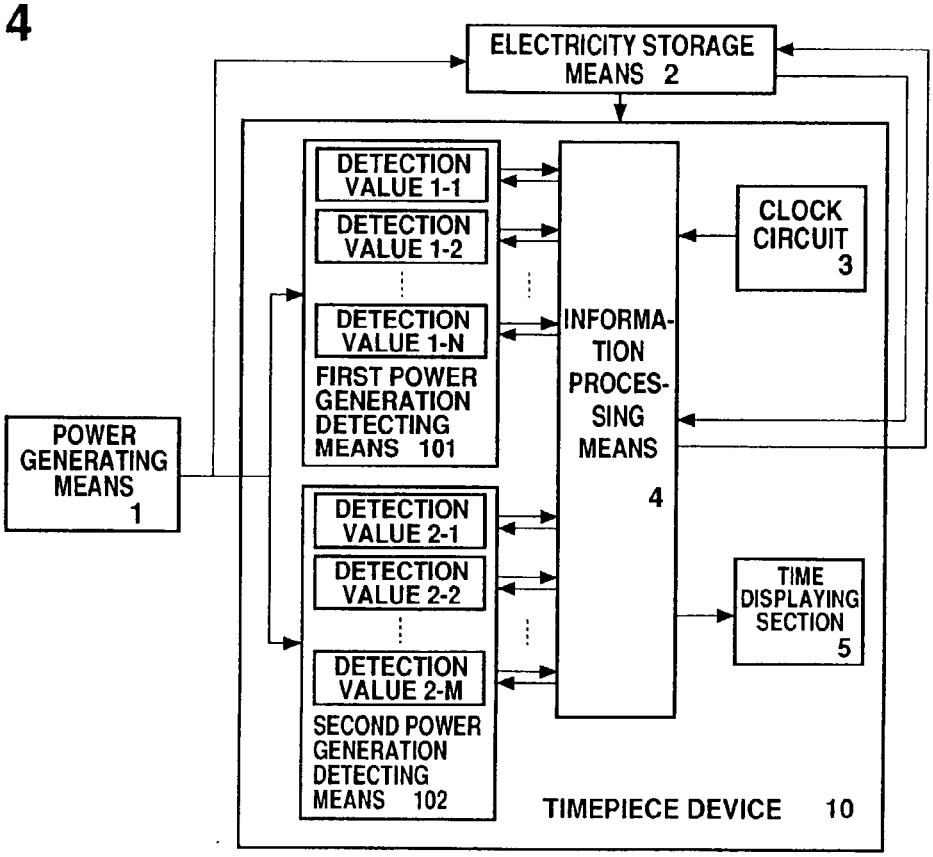
FIG. 4 is a block diagram showing a structure of a fourth embodiment of a power generating electronic timepiece according to the present invention.

FIG. 4 is a block diagram showing a fourth embodiment of a power generating electronic timepiece according to the present invention. The fourth embodiment is characterized in that information on the state of the electricity storage section 2 (for example, the charged voltage value) is input to the information processing means 4 and added to the determination condition for state change. In this manner, an optimal detection value is selected and used from among a plurality of power detection values finely set by the first and second power generation detecting means 101 and 102. For example, when the remaining charged power is small, a power generation level higher than when the remaining charged power is not small is selected for switching the state (in other words, earlier switching to power save state and delayed recovery). Because the condition of the power supply circuit including the electricity storage section 2 is considered for the power level for state switching, a power generating electronic timepiece which is more practical and which has higher power saving effect and easier management ability and a control method of such electronic timepiece can be provided.

The embodiments of the present invention and the details of the embodiments are not limited to the above four embodiments. For example, the number of sampling results used when determining the power generation level is not limited to one, and determination of the power generation level only after the same result is obtained within a predetermined amount of time or a predetermined number of times may be employed to improve the reliability of the determination. Moreover, it is also possible to use other environmental values in place of the amount of generated power, which have a strong correlation relation to the amount of generated power, charged amount, and/or expected future trend of these amounts.

Figure 8:
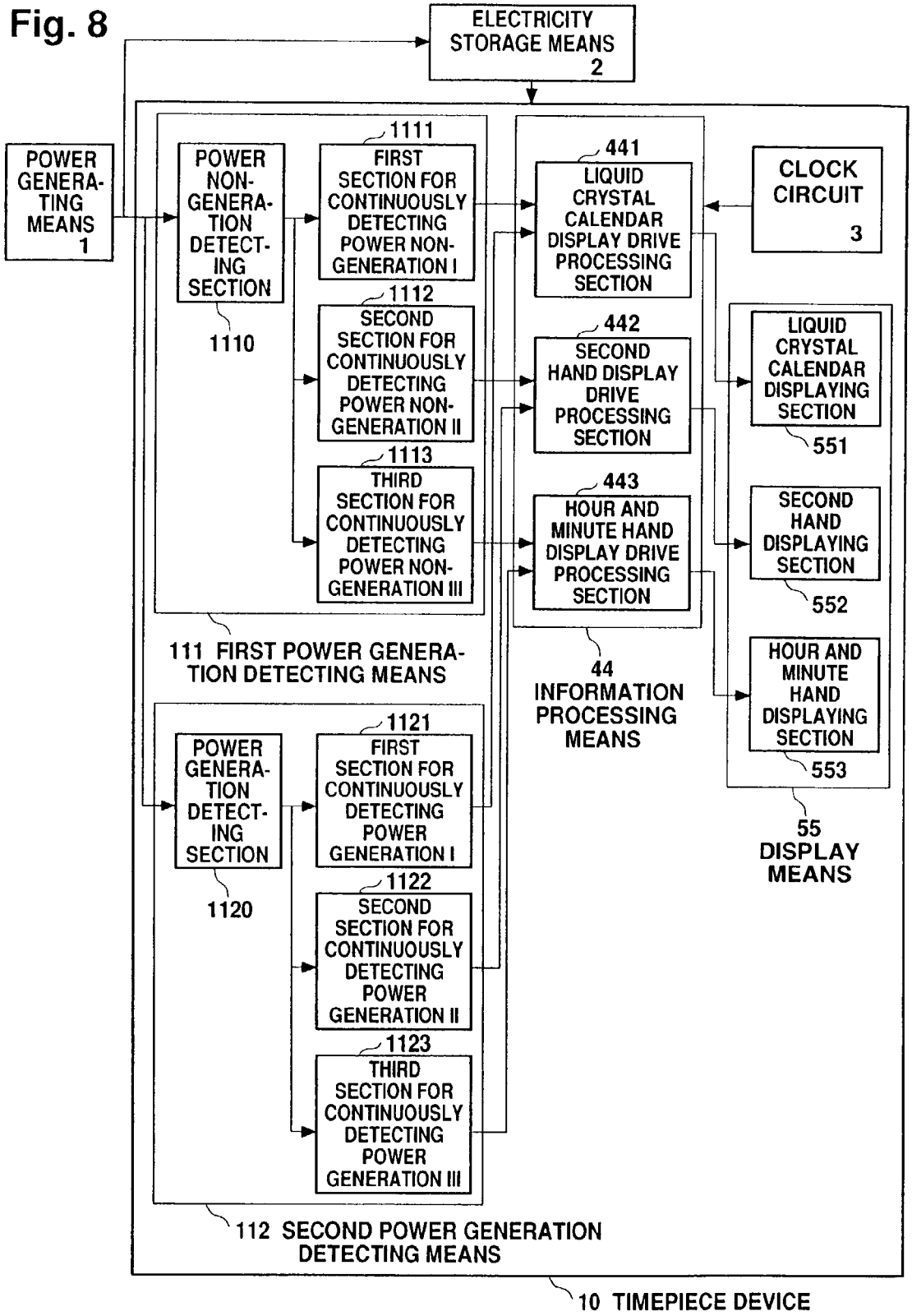
FIG. 8 is a block diagram showing a structure of a fifth embodiment of a power generating electronic timepiece according to the present invention.

FIG. 8 is a block diagram showing a structure of a fifth embodiment of a power generating electronic timepiece according to the present invention. In this embodiment, the power generation level is not determined by single sampling result, but, rather, the power generation level is determined only after the same result is obtained a predetermined number of times, in order to improve the reliability of the determination. In FIG. 8, the power generating means 1, the electricity storage section 2, and the clock circuit 3 are identical to those in the first embodiment. The first power detection means 111 includes power non-generation detecting section 1110 which receives a signal from the power generating means 1, first circuit 1111 for continuously detecting power non-generation, second circuit 1112 for continuously detecting power non-generation, and third circuit 1113 for continuously detecting power non-generation. Each of the three circuits for continuously detecting power non-generation receives a signal output by the power non-generation detecting section 1110 when determining a power generation level of a first level or less by sampling, and outputs a signal when a predetermined number is counted within a predetermined time period. Here, the predetermined numbers of counts are set so that they are increased in the order of first, second, and third circuits 1111, 1112, and 1113 for continuously detecting power non-generation.

Second power generation detecting means 112 includes a power generation detecting section 1120 which receives a signal from the power generating means 1, first circuit 1121 for continuously detecting power generation, second circuit 1122 for continuously detecting power generation, and third circuit 1123 for continuously detecting power generation. Each of the three circuits for continuously detecting power generation receives a signal output by the power generation detecting section 1120 when determining a power generation level of a second level or greater by sampling, and outputs a signal when a predetermined number is counted within a predetermined time period. Here, the predetermined numbers of counts are set such that they decrease in the order of the first, second, and third circuits 1121, 1122, and 1123 for continuously detecting power generation.

Display means 55 comprises a liquid crystal calendar displaying section 551, second hand displaying section 552, and hour and minute hands displaying section 553. Information processing means 44 comprises a liquid crystal calendar display drive processing section 441 for driving the display of the liquid crystal calendar displaying section 551, second hand display drive processing section 442 for driving the display of the second hand displaying section 552, and hour and minute hands display drive processing section 443 for driving the display of the hour and minute hands displaying section 553. Signals from each of the drive processing sections in the information processing means 44 are respectively supplied to the corresponding displaying sections of the display means 55.

In the information processing means 44, the liquid crystal calendar display drive processing section 441, the second hand display drive processing section 442, and the hour and minute hands display drive processing section 443 respectively receives output signals from the first section 1111 for continuously detecting power non-generation, second section 1112 for continuously detecting power non-generation, and third section 1113 for continuously detecting power non-generation. The liquid crystal calendar display drive processing section 441, the second hand display drive processing section 442, and the hour and minute hands display drive processing section 443 also respectively receive output signals from the first section 1121 for continuously detecting power generation, the second section 1122 for continuously detecting power generation, and the third section 1123 for continuously detecting power generation.

In the fifth embodiment, when the output level of the power generating means 1 is lowered and varies, the power non-generation detecting section 1110 determines, by sampling, power generation levels at the first level or less and begins signal output. When the number of counts of the output signals of the power non-generation detecting section 1110 received respectively by the first section 1111 for continuously detecting power non-generation, the second section 1112 for continuously detecting power non-generation, and the third section 1113 for continuously detecting power non-generation exceeds, for example, 10, within a predetermined time period, for example, 40 seconds, a signal is output from the first section 1111 for continuously detecting power non-generation and input to the liquid crystal calendar display drive processing section 441, and drive for the liquid crystal calendar displaying section 551 is suspended. In addition, when the number of counts exceeds 20 within the time period, a signal is output from the second section 1112 for continuously detecting power non-generation and input to the second hand display drive processing section 442, and drive for the second hand displaying section 552 is also suspended. Finally, when the number of counts exceeds 30 within the time period, a signal is also output from the third section 1113 for continuously detecting power non-generation and input to the hour and minute hands display drive processing section 443, and the drive for the hour and minute hands displaying section 553 is also suspended. In this manner, when the number of counts exceeds 30 within the time period, driving of all displaying sections is suspended.

When the output level of the power generating means 1 is elevated and varying, on the other hand, the power generation detecting section 1120 determines, by sampling, a power generation level of the second level or greater, the second level being greater than the first level, and begins signal output. When the number of counts of the output signals of the power generation detecting section 1120 received respectively by the first section 1121 for continuously detecting power generation, the second section 1122 for continuously detecting power generation, and the third section 1123 for continuously detecting power generation 1123 exceeds, for example, 10, in a predetermined time period, for example, 40 seconds, a signal is output from the third section 1123 for continuously detecting power generation and input to the hour and minute hand display drive processing section 443, and drive for the hour and minute hand displaying section 553 is restored. In addition, when the number of counts exceeds 20 within the time period, a signal is output from the second section 1122 for continuously detecting power generation and input to the second hand display drive processing section 442, and driving the second hand displaying section 552 is also resumed. Finally, when the number of counts exceeds 30 within the time period, a signal is also output from the first section 1121 for continuously detecting power generation and input to the liquid crystal calendar display drive processing section 441, and driving of the liquid crystal calendar displaying section 551 is resumed. In this manner, when the number of counts exceeds 30 within the time period, driving of all displaying sections is resumed. The predetermined time period and predetermined number of counts may arbitrarily be selected and set to suit requirements. In this embodiment, step-wise power save states and more reliable switching decisions are possible.

Figure 9:
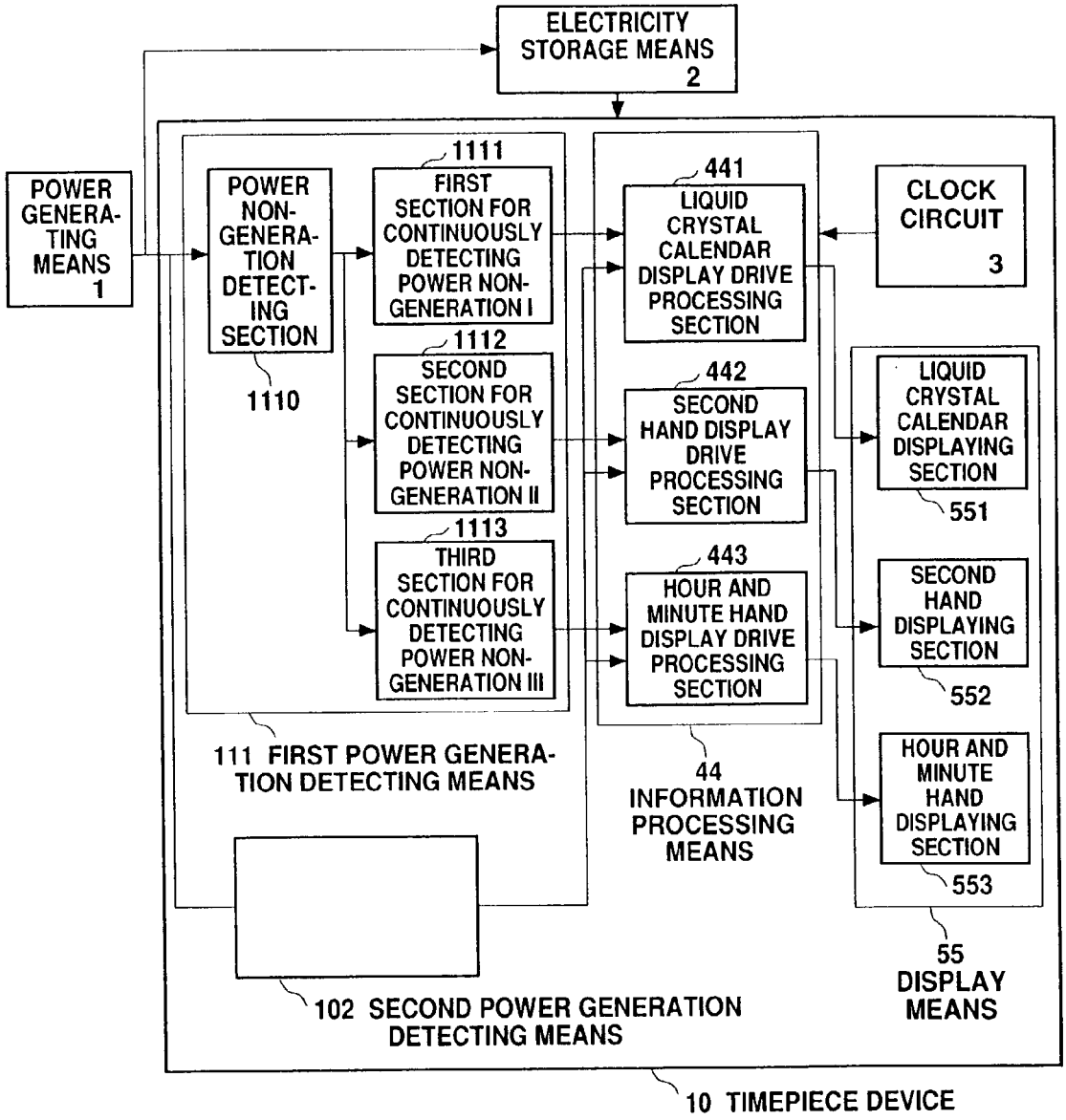
FIG. 9 is a block diagram showing a structure of a sixth embodiment of a power generating electronic timepiece according to the present invention.

FIG. 9 is a block diagram showing a structure of a sixth embodiment of a power generating electronic timepiece according to the present invention. The sixth embodiment differs from the fifth embodiment in that the second power generation detecting means 102, which corresponds to the second power generation detecting means 112 in the fifth embodiment, only includes a power generation detecting section. For example, when this power generation detecting section detects power generation, signals are simultaneously supplied to the liquid crystal calendar display drive processing section 441, second hand display drive processing section 442, and the hour and minute hand display drive processing section 443, in order to recover from the suspension state. In practice, users are more familiar with this kind of restoration.

Moreover, the preferred embodiments and details of the present invention are not limited to the above six embodiments. For example, in the above embodiments, the first state is set to be the normal state and the second state is set to be a power save state where the power consumption is less than in the normal state, and the present invention is used for switching between the normal and power save states. However, the present invention is not limited to the above embodiments. For example, the present invention includes a configuration where the first state is set at a state where the subject matter displayed on the clock display section 5 is a predetermined first subject matter and the second state is set at a state where the subject matter displayed on the clock display section 5 is a predetermined second subject matter. Then, when the carrier of a power generating electronic timepiece determines the state of the timepiece at the clock display section 5, the first and second display subject matters are not frequently switched and frequent change in the display state may be prevented. Thus, a power generating electronic timepiece which can easily be used by the carrier and has an easier management ability or the control method for such an electronic timepiece can be provided.

As noted before, the circuits shown in each block diagram may be formed by a microcomputer which is operated by a program for performing equivalent operations. The types of power generating means and electricity storage section to be used are not limited. In addition, other elements may be added. The power generation level for restoring need not necessarily be higher than the power generating level for transitioning into a deeper power save state.

ADVANTAGES OF THE INVENTION

A basic advantage of the present invention common to the embodiments is that a structure or a control method of a power generating timepiece is provided wherein frequent state change of the timepiece due to small amount of change in generated power is prevented and the stability of the timepiece operation is improved by providing a difference (hysteresis) which depends on the direction of switch, in at least a portion of the power generation levels for switching between a first state (for example, a normal state) and one or more subsequent second states (for example, power save state). The advantages corresponding to each claim will be described below, with the indicated numbers corresponding to the claim numbers.

(1) An advantage is obtained that a power generating electronic timepiece with the above noted basic advantage can be provided.

(2) A power generating electronic timepiece with electricity storage means demonstrates the above basic advantage. In particular, because power detection is performed based on the amount of generated power of the power generating means instead of the electricity storage means, the charged power in the electricity storage means can be prevented from becoming low by the transition to the second state (for example, power save state), thereby realizing an effective advantage (for example, advantage of saving power) that the long-term stability of the timepiece operation is improved.

(3) A direction for hysteresis is defined in order to reliably achieve the above basic advantage.

(4) Decision standards for the power generation and power non-generation are defined in order to reliably achieve the above basic advantage.

(5) In a power generating electronic timepiece, in addition to the above basic advantage, a difference (hysteresis) which depends on the switching direction is provided in at least a portion of the power generation levels for switching between a first state, for example, a normal state, and a second state which has less power consumption than the first state, for example, power save state, the first and second states having different power consumption. In this manner, frequent state change of the timepiece due to small change in the amount of generated power and losses in the power consumption involved in the frequent state switching is prevented and the power saving advantage of the timepiece is enhanced. A similar power saving advantage of the timepiece can also be obtained in when the first state is at a first power save state and the second state is at a second power save state by providing a difference (hysteresis) which depends on the direction of switching in at least a portion of the power generation level to prevent frequent state change of the timepiece due to small change in the amount of generated power and wasted power consumption involved with frequent state switching.

(6) A plurality of detection values for the power generation levels are provided in both directions. In this manner, steps for switching states is increased or the degree of freedom is increased for adjusting the power generation level based on other conditions, in order to perform finer control of the power save states.

(7) More reliable realization of the above basic advantage is achieved by adding the amount of charged power as a criterion for the state switching decision.

(8) More reliable realization of the above basic advantage is achieved by adding the environmental temperature as a criterion for the state switching decision.

(9) The validity and reliability of the decision for state switching operations are improved by confirming that the first power generation level is sustained, thereby achieving greater reliability of the power saving advantage.

(10) The validity and reliability of the decision for state restoring operations are increased by confirming that the second power generation level is sustained, thereby achieving greater reliability of the power saving advantage.

(11) Power save state due to suspension of display operations is clearly shown to clarify the basic advantage.

(12) A structure is presented where a finer, effective power save state can be obtained by suspending a portion of the operations of the time measuring circuit or of circuits other than the time measuring circuit.

(13) Types of display means are clearly defined.

(14) If the power generating means is limited to an optical power generating device, the amount of incident light is greatly dependent on the environment of the timepiece, and directly relates to the amount of generated power. Therefore, the present invention is particularly suitable.

(15) A method for controlling a power generating electronic timepiece having the above basic advantage is provided.

(16) Furthermore, directions of the hysteresis are defined in order to reliably achieve the above basic advantage.

(17) A method for controlling a power generating electronic timepiece which is not limited in the electricity storage means is provided, to achieve the above basic advantage.

INDUSTRIAL APPLICABILITY

As described, according to the present invention, a power generating electronic timepiece and a control method of such electronic timepiece can be provided wherein the power saving advantage is high when there is no power generated or the level of generated power is low, by improving the process for switching between normal and power save states.

The invention claimed is:

1. A power generating electronic timepiece which operates using a power supply device as an energy source, said power supply device comprising at least power generating means, said power generating electronic timepiece comprising:

a time measuring circuit for measuring or calculating predetermined information and outputting the resulting information;

display mean for displaying time information or function information based on a signal output from said time measuring circuit; and control means for controlling states of said power generating electronic timepiece based upon the amount of power generated by said power generating means so as to switch between a first state and a second state in which less power is consumed, wherein if said power generating electronic timepiece is in said first state, said control means makes a first level determination to determine whether or not the amount of power generated by said power generating means is at most a first power generation level, and upon determining that the amount of power is at most said first power generation level, said control means switches to said second state, wherein if said power generating electronic timepiece is in said second state, said control means makes a second level determination to determine whether or not the amount of power generated by said power generating means is at least a second power generation level that is higher than said first power generation level, and upon determining that the amount of power is at least said second power generation level, said control means switches to said first state, and wherein said control means makes said first and second level determinations based on a predetermined period of detection of said amount of power or a plurality of detections of said amount of power.

2. A power generating electronic timepiece according to claim 1, wherein said control means makes said first and second level determinations at least based on a predetermined period of detection of said amount of power.

3. A power generating electronic timepiece according to claim 1, wherein as said first power generation level and said second power generation level, a generation level can be selected from among a plurality of generation levels for respective power generation levels.

4. A power generating electronic timepiece according to claim 1, wherein an arbitrary generation level is selected from among said plurality of generation levels respectively for said first power generation level and said second power generation level based on the charge capacity of said electricity storage means.

5. A power generating electronic timepiece according to claim 1, wherein an arbitrary generation level is selected from among said plurality of generation levels respectively for said first power generation level and said second power generation level based on the temperature of the environment in which said power generating electronic timepiece is placed.

6. A power generating electronic timepiece according to claim 1, wherein at least a portion of display operations of said display means is suspended in said second state.

7. A power generating electronic timepiece according to claim 1, wherein a portion of operations of said time measuring circuit or of circuits other than said time measuring circuit is suspended in said second state.

8. A power generating electronic timepiece according to claim 1, wherein at least a portion of said display means is comprised by an analog display mechanism or a digital display mechanism.

9. A power generating electronic timepiece according to claim 1, wherein a member exhibiting power generation effect when exposed to light energy is used for said power generating means.

10. A power generating electronic timepiece which operates using a power supply device as an energy source, said power simply device comprising at least power generating means, said power generating electronic timepiece comprising:

a time measuring circuit for measuring or calculating predetermined information and outputting the resulting information;

display means for displaying time information or function information based on a signal output from said time measuring circuit; and control means for controlling states of said power generating electronic timepiece based on the signal output from the time measuring circuit so as to switch between a first state in which a predetermined function of said power generating electronic timepiece is not operated and a second state in which the predetermined function of said power generating electronic timepiece is operated, wherein the control means controllably switches to said first state upon detecting a first predetermined number of times that the amount of power generated by said power generating means is at most a first power generation level, and the control means controllably switches to said second state upon detecting a second predetermined number of times that the amount of power generated by said power generating means is at least a second power generation level that is higher than said first power generation level.

11. A power generating electronic timepiece according to claim 10, wherein said first predetermined number of times is set equal to said second number of times.

12. A power generating electronic timepiece according to claim 10, wherein said electronic timepiece further has a predetermined function different from said predetermined function, and upon detecting a third predetermined number of times that the amount of power generated by said power generating means is at at most said first power generation level, said control means switches to a third sate in which neither said predetermined function nor said different predetermined function is operated, the third predetermined number of times being larger than said first predetermined number of times.

13. A power generating electronic timepiece according to claim 12, wherein said control means controllably switches to said first state upon detecting a fourth predetermined number of times that the amount of power generated by said power generating means is at least said second power generation level, the fourth predetermined number of time being larger than said second predetermined number of times.

* * * * *